US011724136B2

(12) United States Patent
Blackford et al.

(10) Patent No.: US 11,724,136 B2
(45) Date of Patent: Aug. 15, 2023

(54) SAFETY APPARATUS COMPRISING MECHANICAL COMMAND INTERFACE

(71) Applicant: 3M INNOVATIVE PROPERTIES COMPANY, St. Paul, MN (US)

(72) Inventors: Matthew J. Blackford, Hastings, MN (US); Steven T. Awiszus, Woodbury, MN (US); Ronald D. Jesme, Plymouth, MN (US); Eric C. Lobner, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 143 days.

(21) Appl. No.: 16/484,707

(22) PCT Filed: Feb. 7, 2018

(86) PCT No.: PCT/IB2018/050763
§ 371 (c)(1),
(2) Date: Aug. 8, 2019

(87) PCT Pub. No.: WO2018/150299
PCT Pub. Date: Aug. 23, 2018

(65) Prior Publication Data

US 2020/0101330 A1 Apr. 2, 2020

Related U.S. Application Data

(60) Provisional application No. 62/459,724, filed on Feb. 16, 2017.

(51) Int. Cl.
*A62B 35/00* (2006.01)

(52) U.S. Cl.
CPC ..... *A62B 35/0093* (2013.01); *A62B 35/0043* (2013.01)

(58) Field of Classification Search
CPC ..... A62B 35/0093; A62B 35/0043; A62B 35/0068; A62B 35/0075
See application file for complete search history.

(56) References Cited

U.S. PATENT DOCUMENTS

| | | | | |
|---|---|---|---|---|
| 5,236,144 | A | 8/1993 | Kautz | |
| 7,237,650 | B2 | 7/2007 | Casebolt | |
| 7,263,782 | B2 | 9/2007 | Steinich | |
| 7,452,100 | B2 | 11/2008 | Swartfager | |
| 7,798,288 | B2 * | 9/2010 | Blasek | E06C 7/186 182/19 |
| 7,946,387 | B2 | 5/2011 | Betcher | |
| 7,987,945 | B2 * | 8/2011 | Petersen | E06C 7/186 182/8 |

(Continued)

FOREIGN PATENT DOCUMENTS

| | | |
|---|---|---|
| CN | 203311589 | 11/2013 |
| CN | 104291178 | 1/2015 |
| WO | WO 2017-223476 | 12/2017 |

OTHER PUBLICATIONS

International Search Report for PCT International Application No. PCT/IB2018/050763, dated May 4, 2018, 4 pages.

*Primary Examiner* — Colleen M Chavchavadze
(74) *Attorney, Agent, or Firm* — Kenneth B. Wood

(57) ABSTRACT

A fall-protection apparatus that includes a computing device configured to detect a mechanical command signal, and methods of using such an apparatus.

19 Claims, 1 Drawing Sheet

(56) References Cited

U.S. PATENT DOCUMENTS

| | | | | |
|---|---|---|---|---|
| 8,430,206 | B2 | 4/2013 | Griffiths | |
| 9,174,073 | B2 | 11/2015 | Casebolt | |
| 9,623,270 | B2 * | 4/2017 | Palet | F16M 11/26 |
| 9,852,598 | B1 * | 12/2017 | Thompson | A62B 35/0093 |
| 9,998,804 | B2 | 6/2018 | Awiszus | |
| 10,347,109 | B2 * | 7/2019 | Troy | A62B 35/0093 |
| 10,496,045 | B2 * | 12/2019 | Hu | G05B 17/02 |
| 2009/0078505 | A1 | 3/2009 | Casebolt | |
| 2010/0219015 | A1 | 9/2010 | Meillet | |
| 2011/0278095 | A1 | 11/2011 | Hetrich | |
| 2012/0217091 | A1 * | 8/2012 | Baillargeon | G08B 21/182 182/18 |
| 2014/0138186 | A1 * | 5/2014 | Macy | A62B 35/04 182/237 |
| 2014/0338186 | A1 * | 11/2014 | Limaye | A61M 5/002 29/700 |
| 2015/0027808 | A1 * | 1/2015 | Baillargeon | A62B 35/0025 182/19 |
| 2016/0107007 | A1 * | 4/2016 | Pollard | A62B 35/0075 182/3 |
| 2016/0287918 | A1 | 10/2016 | Huehn | |
| 2017/0128755 | A1 * | 5/2017 | Denike | A62B 9/04 |
| 2017/0232279 | A1 * | 8/2017 | Strohman | A62B 35/0056 182/36 |
| 2017/0368387 | A1 * | 12/2017 | Fife | A62B 35/0075 |
| 2017/0374436 | A1 * | 12/2017 | Awiszus | G06F 16/24568 |
| 2018/0126198 | A1 * | 5/2018 | Troy | B66C 15/06 |
| 2018/0357879 | A1 * | 12/2018 | Negre | A62B 35/0025 |

* cited by examiner

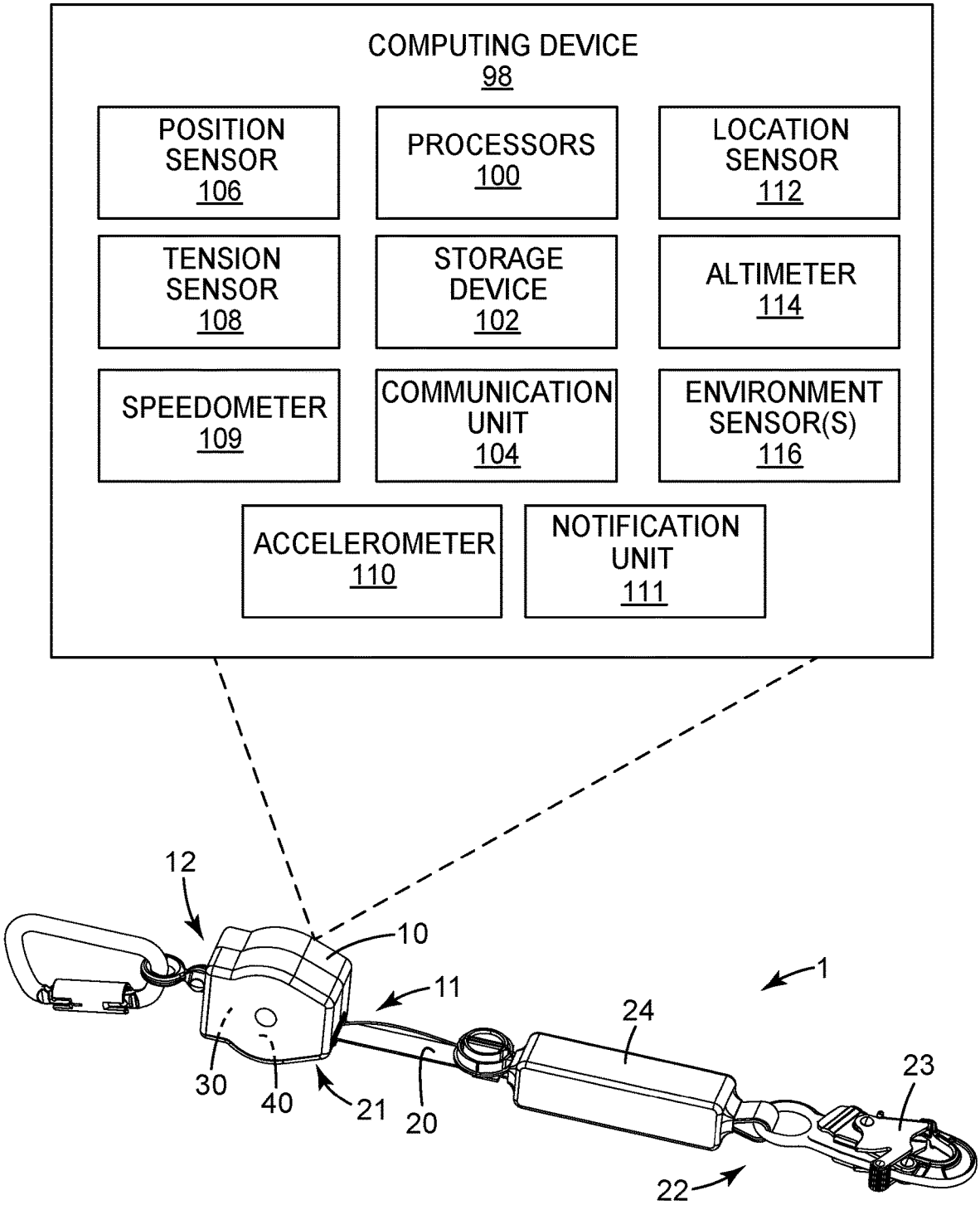
COMPUTING DEVICE
98
POSITION SENSOR
106
PROCESSORS
100
LOCATION SENSOR
112
TENSION SENSOR
108
STORAGE DEVICE
102
ALTIMETER
114
SPEEDOMETER
109
COMMUNICATION UNIT
104
ENVIRONMENT SENSOR(S)
116
ACCELEROMETER
110
NOTIFICATION UNIT
111
12
10
11
1
24
23
30
40
21
20
22

SAFETY APPARATUS COMPRISING MECHANICAL COMMAND INTERFACE

BACKGROUND

Fall protection equipment can be important for persons at potentially harmful heights. For example, workers often wear safety harnesses connected to anchorages via fall protection apparatus such as a self-retracting lifeline (SRL) or a descender. Such an apparatus typically includes a safety line that is wound about a biased drum rotatably connected to a housing. Movement of the worker causes the drum to rotate as the safety line is extended out from, and retracted into, the housing. Such apparatus may further comprise a braking mechanism that can limit or arrest the extending of the line from the device.

SUMMARY

In broad summary, herein is disclosed a fall-protection apparatus that includes a computing device configured to detect a mechanical command signal, and methods of using such an apparatus. These and other aspects will be apparent from the detailed description below. In no event, however, should this broad summary be construed to limit the claimable subject matter, whether such subject matter is presented in claims in the application as initially filed or in claims that are amended or otherwise presented in prosecution.

BRIEF DESCRIPTION OF THE DRAWING

The FIGURE is a conceptual diagram illustrating an exemplary fall-protection apparatus comprising a computing device, as disclosed herein.

The FIGURE is not to scale and is presented purely for the purpose of illustrating different embodiments of the invention. In particular the dimensions of the various components are depicted in illustrative terms only, and no relationship between the dimensions of the various components should be inferred from the FIGURE, unless so indicated. Although terms such as "top", bottom", "upper", lower", "under", "over", "front", "back", "outward", "inward", "up" and "down", and "first" and "second" may be used in this disclosure, it should be understood that those terms are used in their relative sense only unless otherwise noted.

As used herein as a modifier to a property or attribute, the term "generally", unless otherwise specifically defined, means that the property or attribute would be readily recognizable by a person of ordinary skill but without requiring a high degree of approximation. All references herein to numerical parameters (dimensions, ratios, and so on) are understood to be calculable (unless otherwise noted) by the use of average values derived from a number of measurements of the parameter.

DETAILED DESCRIPTION

With reference to the FIGURE, disclosed herein is self-retracting fall-protection safety apparatus 1 of a general type that encompasses products known as self-retracting lifelines and descenders. Such apparatus comprise a housing 10 and a safety line 20 that can be extended out of a first (e.g., lower) end 11 of the housing. A first, proximal end 21 of the safety line is attached to a drum 30 (e.g. to a shaft associated therewith) that is rotatably connected to the housing. A second, distal end 22 of the safety line is configured to be attached to a harness worn by a worker. In some embodiments the distal end of the safety line may be provided with a connecting device (e.g. a hook) 23 to facilitate such attachment. The housing comprises a second (e.g., upper), anchorage end 12 which may be generally opposite the first end from which the line is extendable and which may be connected (whether directly by e.g. a carabiner, hook or D-ring, or indirectly e.g. by an anchorage line) to a secure anchorage of a worksite (e.g., to a girder, beam, scaffolding, or the like). Drum 30 is typically biased (e.g. by a torsion spring) to impart an appropriate rewind force so that the safety line can be extended from the housing as the worker moves away from the housing, and so that the drum automatically retracts the safety line into the housing and rewinds the safety line about the drum as the worker moves toward the housing. The term safety "line" broadly encompasses any suitable rope, wire rope, cable, lanyard, or the like, that can bear the weight of a user and can also bear the increased forces commensurate with arresting a fall of such a user. Such a "line" is not necessarily required to exhibit a circular or even generally circular cross-section (e.g., the line can take the form of a web or belt).

Such apparatus often comprise a braking mechanism 40 that serves to limit or arrest the rotation of drum 30 in the event that the drum begins to rotate above a predetermined speed. Thus, in the event of a worker fall the extent of the descent will be limited with the worker being brought to a stop in a controlled manner or allowed to descend e.g. at a constant, controlled speed. If desired safety line 20 may include e.g. one or more shock absorbers (e.g. one or more accordionized "tear webs") 24 or the like, to further ensure that the speed of falling of the worker is reduced in an appropriately gradual manner. A fall-protection safety apparatus may be configured to controllably bring a worker to a full stop (e.g., as in products commonly known as self-retracting lifelines), or to provide a controlled rate of descent (e.g., as in products commonly known as descenders). In some cases the distinction between these general types of products may not be absolute, with some products serving to at least partially provide one or both functions. Although described herein primarily with regard to "worker" safety, it will be appreciated that apparatus as described herein may find use in other arenas, e.g. in rescue operations. In some embodiments, a fall-protection apparatus as disclosed herein meets the requirements of ANSI Z359.14-2014 and/or ANSI Z359.4-2013.

In some embodiments, the above-mentioned braking mechanism 40 may rely on a centrifugal brake that includes one or more centrifugally-actuated pawls that are biased away from engaging with a braking device (e.g. a ratchet ring), but, upon rotation of the drum above a predetermined speed, are motivated to a position in which they engage with the ratchet ring (thus engaging the centrifugal brake) to limit or arrest the rotation of the drum. However, any suitable braking mechanism may be used.

Apparatus 1 comprises a computing device 98. The term computing device broadly encompasses any electronic or optoelectronic device that includes one or more processors 100 (which in turn may include any suitable components, e.g. microprocessors, integrated circuits, and so on), along with one or more of sensors, communication units, power sources, and so on, as discussed in detail later herein. Such a computing device may be used for a variety of purposes, e.g. for monitoring and/or logging aspects of the use and performance of apparatus 1, for communicating with a mobile device or base unit (e.g. to report the status of apparatus 1 to a base unit and/or to receive instructions from a base unit), and so on. Many such uses, and suitable components and configurations of a computing device of a fall-protection apparatus, are discussed in detail in U.S. Provisional Patent Application No. 62/408,634, entitled Personal Protective Equipment Monitoring and Alerting Platform, which is incorporated by reference in its entirety herein.

As will be discussed in detail later herein, at least one component of computing device 98, including at least one sensor, will be resident on housing 10 of apparatus 1. The term "resident on" broadly encompasses any item that is located on, within, or partially within, housing 10; the term is synonymous with "housing-resident" and does not require that such an item must be located e.g. on an external surface of housing 10. In some embodiments all components of computing device 98 may be resident on housing 10. However, it is not strictly necessary that all components of computing device 98 must be housing-resident. That is, in some embodiments certain components (e.g. one or more processors) may reside in some other location and may be in communication with e.g. one or more housing-resident sensors of apparatus 1.

A user of apparatus 1 may desire to communicate with computing device 98 of apparatus 1 for any of a variety of purposes, some of which are discussed later herein. The term user will often denote a person who is or will be wearing a harness to which safety line 20 of apparatus 1 will be connected; however, in some cases a "user" may be some other associated person (e.g. a co-worker of the person who will actually be wearing the harness). It may be advantageous that such communication with computing device 98 may be achieved by way of a signal that originates from safety line 20 (i.e., by way of manipulation of safety line 20 by a user of apparatus 1). This is because in a work environment, housing 10 of fall-protection apparatus 1 may often be positioned at an elevated location that is not readily accessible to a user; however, the distal end 22 of safety line 20 typically remains in an accessible location or is readily accessible e.g. by way of a lightweight leader line that remains attached to the distal end of the safety line and that can be used e.g. to pull the distal end of safety line 20 down to a user's location.

Herein are provided arrangements and procedures by which a safety line 20 can be manipulated to send a command signal to a computing device 98 of a self-retracting fall-protection apparatus 1. Such a signal will be a mechanical signal, meaning that the signal is transmitted by physical manipulation of safety line 20 by a user and that the signal is received by computing device 98 by way of one or more resulting states of safety line 20 being sensed by at least one sensor that is resident on housing 10, with the signal being identified by computing device 98 as corresponding to a known command. By definition a mechanical signal does not embrace any signal sent by electrical, electromagnetic, or optical means (although of course the state of safety line 20 may be sensed by any of these means, e.g. by an optical sensor). By a command signal is meant a signal that is readily identifiable by computing device 98 as being an intentional command derived from deliberate manipulation of safety line 20 by a user, as distinguished from e.g. motions of safety line 20 that may occur as a user of apparatus 1 moves around in the course of performing work.

Computing device 98 may comprise any suitable components, arranged as desired. Computing device 98 will include at least one sensor that is resident on housing 10 of apparatus 1 and that is configured to sense a state of safety line 20. In some embodiments, the at least one sensor that is resident on housing 20 may include one or more position sensors 106. By a position sensor is meant a sensor configured to monitor the position of safety line 20; i.e., the distance to which line 20 is extended outward from within housing 10 or is retracted within housing 20. Such monitoring may be performed by any suitable method, e.g. by optical, capacitive, ultrasonic or inductive interrogation. Such monitoring may be achieved by monitoring the position of line 20 itself, facilitated if desired by fiduciary marks on line 20; or, it may achieved by monitoring the position of (and e.g. the number of complete or partial rotations of) drum 30, facilitated if desired by fiduciary marks on drum 30. Position sensor 106 may be chosen from e.g. an optical sensor, a rotary encoder, a Hall effect sensor, a capacitive sensor, an ultrasonic sensor, an inductive sensor, or in general any sensor that can suitably directly monitor the position of line 20 whether directly or by monitoring the rotational position of drum 30.

In some embodiments, the at least one sensor that is resident on housing 10 may include one or more tension sensors 108. By tension sensor is meant a sensor configured to monitor the tension on safety line 20. In some embodiments tension sensor 108 may take the form of a force transducer (e.g. a load cell) placed in-line with safety line 20 to directly or indirectly measure the tension on line 20. In some embodiments, tension sensor 108 may include a strain gauge to measure static force or static tension on safety line 20. Tension sensor 108 may additionally or alternatively include a mechanical switch having a spring-biased mechanism is used to make or break electrical contacts. In some embodiments, tension sensor 108 may monitor the tension on line 20 by suitable monitoring of the rotational tension (e.g., force) on drum 30.

In some embodiments, the at least one sensor that is resident on housing 10 may include one or more speedometers 109. By a speedometer is meant a sensor configured to monitor the speed at which line 20 is being extended from, or retracted into, housing 10 of apparatus 1. For example, speedometer 109 may measure extension and/or retraction of safety line 20 (or it may receive such measurement from position sensor 106) and ratio the extension and/or retraction to a time scale (e.g., divide by time). Speedometer 109 may operate by direct monitoring of safety line 20, and/or by monitoring of the speed of rotation of drum 30.

In some embodiments, the at least one sensor that is resident on housing 10 may include one or more accelerometers 110. By an accelerometer is meant a sensor configured to monitor changes in the speed at which line 20 is being extended from, or retracted into, housing 10 of apparatus 1. Accelerometer 110 may e.g. make use of, or function in concert with, either or both of a position sensor 106 and a speedometer 109, and may operate by direct monitoring of line 20 or by monitoring of drum 30, as desired.

Any such sensor or sensors as described above may send a signal to a processor 100 of computing device 98 to allow computing device 98 to monitor the state of safety line 20 in order to identify a mechanical command signal. In some embodiments, sensors of any of the various types listed above may be used in combination in order to allow computing device 98 to monitor the state of safety line 20. (It will be appreciated that in sensing via any of the above-listed sensors and sensing mechanisms, a correction may be applied if needed in order to account for variation in the diameter of the drum-wrapped portion of line 20 as line 20 is extended from, or retracted into, housing 10.) Any suitable mechanical command signal, originating from any suitable manipulation of safety line 20, may be conveniently used.

All that is necessary is that the manipulation result in states (e.g. position, speed, acceleration, and/or tension, or any combination thereof) of safety line 20 that can be monitored by one or more sensors of computing device 98, and that can be identified by computing device 98 as corresponding to a command signal. In particular embodiments, a command signal may take the form of a predetermined sequence of states of safety line 20.

In some embodiments, a command signal may comprise a predetermined sequence of motions of safety line 20 outward and inward from housing 10. Such a predetermined sequence may thus include at least one extension (unwinding from the drum) of the safety line and/or at least one retraction (rewinding onto the drum) of the safety line, in any order. Such a retraction and/or extension may involve a motion of the safety line of e.g. a few cm to a fraction (e.g. up to ½) of a meter; such actions do not necessitate a complete extension or retraction of the safety line (that is, they do not necessitate a complete unwinding of the line from the drum or rewinding of the line onto the drum). In some embodiments such a predetermined sequence may involve any suitable sequence of successive, alternating extensions and retractions of the safety line. By way of specific example, such a predetermined sequence might take the form of two, three, four or more pairs of extensions/retractions or retractions/extensions. In some embodiments, such extensions and/or retractions may have to fall into a certain magnitude (e.g., from about 1 cm to about 30 cm, or from about 3 to about 10 cm) to be recognized by computing device 98 as potentially being part of a command signal.

In some embodiments, a command signal may involve one or more predetermined wait times during which the safety line is held stationary, e.g. in between successive extensions and/or retractions. By way of specific example, a command signal might involve an extension (of e.g. a few cm), followed by stationary wait time of e.g. a few seconds, followed by another, similar extension, followed by another stationary wait time interval, followed by still another extension (or by a retraction). Or, a command signal might involve an extension, followed by a stationary interval, followed by a retraction, followed by a stationary interval, followed by another extension or another retraction. In other embodiments, extensions and/or retractions may not be interrupted by wait times.

The control variables that are available for a mechanical command signal thus include the pattern of extensions and/or retractions that are used (e.g. extension/extension/retraction, extension/retraction/extension, extension/retraction/retraction, retraction/extension/retraction, and so on). The available control variables also include the interval of wait time between successive motions (extensions or retractions) of the safety line, and the magnitude of the distance of extension or retraction of the safety line out of or into the housing.

It will be appreciated that a large number of combinations of such control variables are possible. From these possibilities, any desired set of manipulations may be chosen as a mechanical command signal. For example, a first action might be a small retraction (e.g. 2-5 cm) of the safety line, followed by a wait time of a few seconds, followed by an extension of roughly twice that magnitude, followed by another wait time, followed by another small retraction. It will be appreciated that the upper and lower limits of any line displacement, wait time interval, etc., may be set as narrow or wide as appropriate in order for a user to be able to easily perform the operation and for computing device 98 to be able to recognize the line displacement, wait time interval, etc. as falling within the ranges of a step of a mechanical command. (For example, in order to qualify as a step of a mechanical command, an extension might need to be e.g. 2-4 cm, or 4-10 cm; similarly, a stationary "hold" might need to have a duration of e.g. 1-2 seconds, or 2-5 seconds.) It is emphasized that all of the specific sequences, numerical values, etc., that are provided above, and additional specific sequences and numerical values presented later herein, are merely illustrative examples and that any desired sequences, values, etc., in any desired combination, can be used. All that is needed is that the sequences, numerical values, etc. be chosen so that the result is recognizable by computing device 98 as being a purposeful command derived from deliberate manipulation of safety line 20 rather than being the result of motions of safety line 20 that occur as a user of apparatus 1 performs activities in the workplace.

In some embodiments, the activation of a braking mechanism 40 of housing 10 of apparatus 1 (as discussed earlier herein) may be used to provide at least one step of a sequence of manipulations of safety line 20 that is identifiable by computing device 98 as a mechanical command signal. Specifically, a rapid and forceful extension (e.g. a forceful tug) of safety line 20 may be sufficient to engage the braking mechanism (e.g., such a tug may cause pawls of a centrifugal braking mechanism to engage with a ratchet ring). Engaging the braking mechanism will "lock up" drum 30 thus causing the safety line to come to a halt. (In contrast, a slower, more gentle pull on safety line 20, e.g. an extension as described above, will result in safety line 20 being extended from housing 10 without the braking mechanism engaging.)

Any appropriate sensor or combination of sensors (e.g. an extension sensor and a tension sensor or accelerometer) may be used to determine whether drum 30 is in a lock-up condition. In some embodiments one or more sensors may e.g. directly monitor a pawl or pawls of the braking mechanism to determine whether the braking mechanism is engaged; in such cases it may not be necessary to monitor drum 30, although this may still be done if desired. Ordinary artisans will understand that a braking mechanism can be disengaged from an engaged (lock-up) condition by removing most or all of the force that is applied to safety line 20. Upon such action, the biasing force of drum 30 will cause drum 30 to rotate in a "rewind" direction which will e.g. cause the pawls to disengage thus changing the braking mechanism out of its engaged condition.

Thus in some embodiments one or more lock-up tugs may be included as steps of a mechanical command signal. For example, a succession (e.g., two, three, or four) of lock-up of safety line 20, e.g. with a predetermined wait time interval in between, may provide a command signal. Or, one or more such lock-ups may be interspersed with one or more of the above-described (non-lock-up) extensions and/or retractions as achieved by slower and less forceful manipulations of the safety line. Thus in summary, lock-ups of braking mechanism 40 and drum 30 provide an additional control variable that may be used, alone or in combination with any of the above-described control variables, to provide a mechanical control signal.

The above discussion of monitoring pawls of a braking mechanism to detect a lock-up condition merely presents one particular way in which monitoring of one or more components of a braking mechanism 40 of housing 10 of apparatus 1 may be used, either alone or in combination with e.g. one or more other sensors of the types disclosed earlier herein, to monitor a state of safety line 20. Other uses of other components of braking mechanism 40 are possible. For example, the rotational position and/or rotational speed of, and/or the torque experienced by, a ratchet ring of a braking mechanism (e.g. a friction-braking mechanism of the general type described in U.S. Pat. No. 8,430,206) may be monitored e.g. in order to infer the magnitude of any tension on safety line 20.

The discussions herein make it clear that a state of safety line 20 may be monitored directly e.g. by monitoring the position, speed, acceleration, or tension of safety line 20, or may be monitored indirectly e.g. by monitoring the position, speed, acceleration, or tension of drum 30 and/or by monitoring some component of braking mechanism 40. It will thus be understood that the concept of monitoring a state of safety line 20, and of identifying a set of such states as constituting a command signal, does not require that safety line 20 must be monitored directly. Rather, in some embodiments this may be achieved at least in part by monitoring drum 30 and/or by monitoring braking mechanism 40. Thus, the concept of a housing-resident sensor that is configured to sense a state of safety line 20 is not restricted purely to sensors that monitor safety line 20 directly. In fact, in some embodiments it may be more convenient to monitor drum 30 (e.g. by way of an optical rotary encoder) than to monitor safety line 20 directly.

Furthermore, if, for example, the rotational speed of drum 30 is what is monitored, it is not necessary that computing device 98 (e.g. processor 100 thereof) perform calculations to explicitly convert the speed of drum 30 to e.g. a numerical value of the speed of safety line 20, in order to sense a "state" of safety line 20. Rather, a speed of drum 30 can itself be used to infer a state of safety line 20 with sufficient particularity to determine whether the state corresponds to a part of a mechanical command signal, regardless of whether a specific numerical value of e.g. a speed of safety line 20 (or a speed of drum 30) is ever explicitly calculated. The same holds for any other parameter (e.g. position, acceleration, and so on).

It is thus emphasized that computing device 98 can receive and identify a mechanical command signal that originates from safety line 20, by way of at least one housing-resident sensor that is configured to sense a state of the safety line, without requiring that the safety line be monitored directly. For example, in some embodiments, drum 30 may be the only entity that is monitored by the at least one housing-resident sensor. In some embodiments, a combination of housing-resident sensors (e.g. at least one sensor that monitors safety line 20 directly, and at least one other sensor that monitors drum 30 and/or that a component of braking mechanism 40) may be used.

As discussed above, computing device 98 is configured to receive (e.g. by way of one or more sensors as discussed above) information regarding the state of safety line 20. Computing device 98 is configured to identify, from amongst such information, one or more command signals if present. That is, computing device 98 is configured to recognize a sequence of states of safety line 20 that correspond to a command signal and to distinguish such a command signal from incidental motions of safety line 20 that result from e.g. worker movements as the worker performs job functions. Computing device 98 may include any number of e.g. processors 100 that may aid in such identification of a command signal. Such a processor or processors may include any useful component or entity, e.g. one or more microprocessors (e.g. digital signal processors (DSPs), application specific integrated circuits (ASICs), field-programmable gate array (FPGAs), or equivalent discrete or integrated logic circuitry, and the like. Computing device 98 may also include one or more data storage devices 102 to facilitate such operations.

A processor 100 may include algorithms configured to recognize a command signal; such algorithms may be present in e.g. hardware, firmware, software, flash memory, or in any other suitable form or format. (In some embodiments such algorithms may reside in a data storage device 102 but will be readily accessible to processor 100.) Such a processor may receive information from one or more of the aforementioned sensors (and may send output signals e.g. upon ascertaining that a mechanical command signal has been received) by any suitable means, e.g. by direct electrical or fiber-optic connection or by wireless transmission. While in many embodiments it may be convenient that any such processor 100 may be resident on housing 10 of apparatus 1, in some embodiments such a processor may be located other than on housing 10 and may thus be in communication, e.g. wireless communication, with any of the aforementioned sensors that are resident on housing 10.

It will be appreciated that in different workplaces and with different work functions (e.g. framing, wiring, painting, welding, mortaring, and so on), particular combinations of movements of safety line 20 may be better suited for use as mechanical command signals. That is, some movements of safety line 20 may be less likely to occur as a result of particular workplace activities and thus may be well suited to serve as mechanical command signals in particular work environments. In some embodiments a computing device 98 of an apparatus 1 may offer a menu of many different mechanical commands that can be chosen from, varying in any or all of the number of line movements and/or brake lock-ups, wait time intervals between line movements and/or lock-ups, the magnitude and/or direction (extension/retraction) of line movements, and so on. In some embodiments the individual steps that collectively constitute a command signal may be choosable à la carte and/or may be individually customized. For example, a user might select a command signal consisting of a lock-up, a wait time of a duration chosen by the user, a retraction of a magnitude chosen by the user, followed by another lock-up.

In some embodiments, computing device 98 may be configured so that it can be put into a learning mode, after which a desired, e.g. customized, set of line manipulations may be carried out by a user. The resulting set of states of safety line 20 (as monitored by any of the above-described sensors) may then be remembered by computing device 98 (i.e. may be held resident in a processor 100 and/or in a storage device 102) as corresponding to a particular mechanical command signal. In some embodiments, computing device 98 may be configured to recognize any number of mechanical command signals (e.g. one, two, three, four, five, or more), associated with different actions to be taken by computing device 98, whether such command signals are e.g. pre-installed or user-customized. It will be appreciated that the term "pre-determined" as used herein encompasses sequences of line manipulations and resulting line states that are e.g. generated by a user while computing device 98 is in learning mode. In other words, such sequences and resulting line states do not have to be pre-installed at a factory at which apparatus 1 is produced, or chosen by the user from existing items of a menu, in order to qualify as "pre-determined".

In some embodiments, two different mechanical command signals may be used in pairwise fashion. For example, two lock-ups in succession may instruct computing device 98 to change from an initial state to second state, while three lock-ups in succession may instruct computing device 98 to change from the second state back to the initial state. In some embodiments, a single command may be used in on-off-on-off ("toggle") fashion. For example, when computing device 98 is in an initial state, two lock-ups followed by a retraction may instruct computing device 98 to change from the initial state to a second state. When computing device 98 is in the second state, this same signal may instruct device 98 to change from the second state back to the initial state.

The above discussions make it clear that in some embodiments computing device 98 may be user-accessible so that the user can modify operating parameters, can teach computing device 98 new or modified mechanical command signals and their associated actions, and so on. Thus in some embodiments, computing device 98 may be equipped with a user-accessible operating system such as Microsoft Windows, Apple OS X, or Linux, to name only a few examples. As another example, a computing device 98 may be equipped with, or at least may be able to communicate with and to receive programming instructions from, a mobile-device operating system, such as Google Android, Apple iOS, Microsoft Windows Mobile, or BlackBerry OS to name only a few examples. Computing device 98 may be configured to perform a wide variety of other functions (e.g. one or more monitoring functions, communication or signaling functions, data storage functions, and so on) in addition to identifying and acting on a mechanical command signal.

Computing device 98 may take at least one action upon ascertaining that a mechanical command signal has been received. Such an action can be any of a variety of desired actions. In some embodiments, such an action may comprise changing computing device 98 from a stand-by state to a ready state or vice versa. By a stand-by state is meant a state in which many of the functions of computing device 98 are deactivated (e.g. to conserve power), e.g. with only such components (e.g. at least one sensor and an associated processor) remaining active as are needed to detect a mechanical command signal. In some embodiments, such an action may comprise logging a time event (e.g. a start time or end time of a work period or of a particular work operation). In some embodiments, such an action may comprise performing a self-check of computing device 98. Other possible actions include computing device 98 switching from a low-power (range) wireless communication mode to a high-power wireless communication mode (or vice-versa), or performing an interrogation of a particular workplace parameter (e.g. an environmental condition). In some embodiments the action taken by computing device 98 may consist partly, or purely, of logging an action or status of a user of apparatus 1. For example, a user might send a particular command signal to notify computing device 98 that the user has attached the distal end of safety line 20 to the user's harness (or has detached safety line 20 from the harness). In some embodiments, upon receiving a command signal, computing device 98 may take no action beyond simply logging that the command signal was received.

In some embodiments computing device 98 may perform a notification action, for example emitting a visible signal (e.g. a blinking light) or emitting an audible signal (e.g. a beep), that, for example, signals a user of apparatus 1 that computing device 98 is now in a ready state or is now in a stand-by state. Such an action may make use of a notification unit 111, which will be considered to be a component of computing device 98. In some embodiments, such a notification action may be subsequent to a precursor action, with the notification action serving to notify a user of apparatus 1 that the precursor action has been carried out. For example, a user may send a mechanical command signal that instructs computing device 98 to awake from a stand-by state and enter a ready state; computing device 98 may perform this action and then emit a notification signal to confirm to the user that computing device 98 is now in a ready state. It will be appreciated that many of the above-described actions fall into the category of non-mechanical actions, meaning that the action taken by computing device 98 does not involve any kind of physical manipulation of safety line 20.

In some embodiments, an action taken by computing device 98 upon receipt of a mechanical command signal may be a non-mechanical action that comprises wirelessly communicating with a mobile device (e.g. a portable computing device, such as a smart phone or tablet computer) carried by a user of apparatus 1, or a base unit (meaning a computing device that, whether or not it is portable, is not carried by a user during normal workplace activities). For example, such an action may be for the purpose of establishing an initial communication with the mobile device or base unit and/or for confirming to the mobile device or base unit that computing device 98 is in a ready state.

In specific embodiments, such an action may take the form of computing device 98 of an apparatus 1 establishing communication with a mobile device carried by a particular person who is or will be using that apparatus 1, and pairing computing device 98 with that mobile device. By "pairing" is meant that computing device 98 recognizes that particular mobile device and will not confuse wireless signals from that mobile device with those from any other mobile device; the mobile device likewise recognizes computing device 98. For example, upon receipt of a mechanical command signal, computing device 98 may send a wireless query for the presence of a nearby mobile device. Upon detecting such a mobile device, computing device 98 may then establish communication with the mobile device (and may e.g. perform an electronic handshake with the mobile device).

After communication is established between computing device 98 and a mobile device (or e.g. a base unit), any suitable information can be exchanged therebetween, e.g. data transmission, status notification, alerts, and so on. In some embodiments, a status of computing device 98 (or of apparatus 1 as a whole) may be presented on a display screen of a mobile device and/or of a base unit. Computing device 98 may remain in continuous or discontinuous communication with the mobile device (and/or base unit) until such time as another command is received to break the connection. That is, in some embodiments a communication action that is performed upon receipt of a particular mechanical command signal, will be an action to terminate communication, e.g. at the end of a work period.

In some embodiments, upon detecting the presence of a nearby mobile device, computing device 98 may issue a notification signal after which the user of apparatus 1 may send a signal to computing device 98 confirming that the particular mobile device is indeed the one that is desired for computing device 98 to be paired with. In various embodiments, such a confirmation signal might be in the form of a mechanical command signal as disclosed herein or might be a wireless transmission sent from the mobile device. Such an arrangement can provide that a particular apparatus 1 and computing device 98 thereof, can identify a mobile device that is associated with a particular worker, and can establish and maintain communication with that mobile device even in the presence of other mobile devices and/or of other apparatus 1 and computing devices 98.

It will be appreciated that the above-described procedure is merely one example of a general arrangement in which a user who desires computing device 98 to perform a particular action can send an initial mechanical command signal. Upon receiving and recognizing the initial command signal, computing device 98 can respond by emitting a request-for-confirmation signal (e.g. a visible or audible notification signal, or an electronic signal sent to a particular mobile device carried by the user). Upon receipt of the request-for-confirmation signal, the user can then send a confirmation signal (which may be a mechanical command signal, or may be sent electronically by way of a mobile device) to computing device 98. Only upon receipt of this confirmation signal from the user will computing device 98 carry out the particular action that is desired by the user. It will thus be appreciated that such arrangements can provide that, if desired, a multi-step signaling protocol may be used, e.g. to verify that computing device 98 is in communication with the proper user and/or mobile device, prior to carrying out a particular command.

Computing device 98 may be provided with a communication unit 104 to facilitate communications between computing device 98 and one or more mobile devices and/or one or more base units. Communication unit 104 may rely on any suitable mode of wireless communication, e.g. Bluetooth, wi-fi/internet, optical (infrared), and so on. For example, a communication unit 104 may be configured to be compatible with wireless technology such as 602.11 wireless networks, 602.15 ZigBee networks, and the like. Computing device 98 thus may e.g. communicate wirelessly directly with a mobile device or base unit via e.g. Bluetooth technology, optical technology using e.g. infrared transmission and so on; or, computing device 98 may communicate with any such mobile device or base unit through a network using e.g. wireless access points, local area networks, and so on. Potentially suitable communication techniques may include e.g. TCP/IP, Ethernet, Wi-Fi, Bluetooth, 4G, LTE, to name only a few examples. In some instances, communication unit 104 may operate in accordance with the Bluetooth Low Energy (BLE) protocol.

If a user of apparatus 1 is equipped with a mobile device as described above, such a mobile device may be configured to communicate with computing device 98, to send instructions thereto, to receive communications therefrom, in multiple ways and for numerous purposes. It will be appreciated that such interactions may be much more numerous and varied than the specific interactions for which it is desired to provide mechanical command signals as disclosed herein. It will also be appreciated that in some embodiments computing device 98 may communicate with multiple devices (whether e.g. mobile devices, base units, and so on). For example, computing device 98 may participate in a so-called "mesh network" of devices which collectively form a set of nodes that are configured to relay information through the network along any of a variety of pathways.

Computing device 98 may be configured to identify any number of different mechanical command signals, and to perform any number of associated actions, as desired. (It will be understood that the exemplary actions presented herein represent only a small sampling of possible actions that may be performed.) Although in some instances a user of apparatus 1 may be equipped with a mobile device (e.g. smart phone) that may be able to communicate wirelessly with apparatus 1, it still may be advantageous to provide mechanical command signals as disclosed herein, e.g. for the purpose of establishing initial communication between computing device 98 and a mobile device. In particular, in some cases it may be inconvenient for a user to communicate commands to computing device 98 by way of a mobile device. For example, a user may be wearing bulky gloves that render it difficult to operate a mobile device, but that do not prevent the user from grasping safety line 20 so as to easily perform a predetermined sequence of e.g. extensions, retractions, wait time intervals, and/or lock-ups. In fact, some mechanical command signals may be sent in a hands-free manner, e.g. by way of the user successively crouching and rising, stepping (or leaning) backwards and forwards, etc., so as to impart the desired motions to the safety line, with suitable pauses in between if the mechanical command signal includes wait intervals.

Computing device 98 may include any other components (e.g. electronic components, optoelectronic components, and so on) as desired. For example, additional sensors, e.g. a location sensor 112 such as a GPS unit, an altimeter 114, an environment sensor 116 (which may sense any or all of e.g. temperature, humidity, wind speed, noise, the amount of ambient light, and so on), may also be present, although such a sensor or sensors may not necessarily function to identify a mechanical command signal. Computing device 98 may comprise any number of data-storage devices 102 as desired. Such a storage device 102 may include one or more of a short-term memory or a long-term memory. Storage device 102 may include, for example, random access memories (RAM), dynamic random access memories (DRAM), static random access memories (SRAM), magnetic hard discs, optical discs, flash memories, or forms of electrically programmable memories (EPROM) or electrically erasable and programmable memories (EEPROM). Computing device 98 may include other components and functionalities as may be useful or advantageous in various circumstances, as discussed in detail e.g. in the aforementioned U.S. Provisional Patent No. 62/408,634. Computing device 98 may include any suitable power source, e.g. an internal power source such as a rechargeable battery. Device 98 may also include a connection (whether a physical connection or a wireless connection) that allows device 98 to be powered and/or that allows a rechargeable battery to be charged.

It will be understood that the architecture, components, and arrangements of computing device 98 (and, more broadly, of fall-protection apparatus 1) illustrated in the FIGURE are shown for exemplary purposes only. In other embodiments, apparatus 1 and computing device 98 thereof may be configured in a variety of other ways having additional, fewer, or alternative components than those shown in the exemplary FIGURE. For example, in some instances, computing device 98 may be configured to include only a subset of components, such as a subset of the depicted sensors, e.g. along with at least one processor and at least one communication unit. Moreover, while the FIGURE illustrates all components of computing device 98 being resident on housing 10 of apparatus 1, this is not strictly necessary, as noted previously herein.

List of Exemplary Embodiments

Embodiment 1 is a self-retracting fall-protection apparatus comprising: a housing; a rotatable drum that is connected to the housing; and, a safety line with a proximal end attached to the rotatable drum and a distal end that is attachable to a harness of a user of the device; wherein the apparatus comprises a computing device configured to receive and identify a mechanical command signal that originates from the safety line, by way of at least one housing-resident sensor that is configured to sense a state of the safety line; and wherein the computing device is configured to perform at least one action upon receiving and identifying the mechanical command signal.

Embodiment 2 is the apparatus of embodiment 1 wherein the at least one housing-resident sensor is chosen from at least one of a position sensor, a tension sensor, a speedometer, or an accelerometer, and combinations of sensors of any or all these types.

Embodiment 3 is the apparatus of any of embodiments 1-2 wherein the computing device is configured to receive and identify a mechanical command signal that originates from the safety line, by using at least one housing-resident sensor to directly interrogate at least one of a position, a tension, a speed, or an acceleration, of the safety line.

Embodiment 4 is the apparatus of any of embodiments 1-3 wherein the computing device is configured to receive and identify a mechanical command signal that originates from the safety line, by using at least one housing-resident sensor to interrogate at least one of a rotational position, a rotational tension, a rotational speed, or a rotational acceleration, of the drum to which the proximal end of the safety line is attached.

Embodiment 5 is the apparatus of any of embodiments 1-4 wherein the at least one housing-resident sensor is configured to sense a state of the safety line by way of monitoring at least one component of a braking mechanism of the housing of the apparatus.

Embodiment 6 is the apparatus of any of embodiments 1-5 wherein the computing device is configured to receive and identify a mechanical command signal that comprises a predetermined sequence of motions of the safety line that includes at least one retraction of the safety line.

Embodiment 7 is the apparatus of any of embodiments 1-6 wherein the computing device is configured to receive and identify a mechanical command signal that comprises a predetermined sequence of motions of the safety line that includes at least one extension of the safety line.

Embodiment 8 is the apparatus of any of embodiments 1-7 wherein the computing device is configured to receive and identify a mechanical command signal comprising a predetermined sequence of motions of the safety line that includes at least successive, alternating extensions and retractions of the safety line.

Embodiment 9 is the apparatus of any of embodiments 1-8 wherein the computing device is configured to receive and identify a mechanical command signal that includes at least one predetermined wait time interval during which the safety line is held stationary.

Embodiment 10 is the apparatus of any of embodiments 1-9 wherein the computing device is configured to receive and identify a mechanical command signal that includes at least one engaging of a braking mechanism of the housing of the apparatus.

Embodiment 11 is the apparatus of any of embodiments 1-10 wherein the computing device is configured to receive and identify a mechanical command signal that comprises a predetermined sequence of successive, alternating engagings and disengagings of a braking mechanism of the housing of the apparatus.

Embodiment 12 is the apparatus of any of embodiments 1-11 wherein the computing device is configured to perform at least one action that is a non-mechanical action.

Embodiment 13 is the apparatus of any of embodiments 1-12 wherein the computing device is configured to perform at least one of the following actions: changing the computing device from a stand-by state to a ready state; changing the computing device from a ready state to a stand-by state; performing a self-check of the computing device; logging a time event; logging an action and/or status of a user of the apparatus; and monitoring an environmental parameter.

Embodiment 14 is the apparatus of any of embodiments 1-13 wherein the computing device is configured to perform at least one action that is a notification action chosen from the group of actions consisting of emitting a visible signal and emitting an audible signal.

Embodiment 15 is the apparatus of any of embodiments 1-14 wherein the computing device is configured to receive and identify an initial mechanical command signal, to send a request-for-confirmation signal upon receiving and identifying the initial command signal, to receive and identify a confirmation signal, and to take an action upon receiving and identifying the confirmation signal.

Embodiment 16 is the apparatus of any of embodiments 1-15 wherein the computing device is configured to perform at least one action that is a communication action comprising sending a wireless communication to a mobile device and/or to a base unit.

Embodiment 17 is the apparatus of any of embodiments 1-16 wherein the computing device is configured to perform at least one action that is a communication action chosen from the group consisting of: establishing communication with a mobile device carried by a user of the fall-protection apparatus and pairing the computing device with the mobile device; and, terminating communication with a mobile device with which the computing device had been previously communicating.

Embodiment 18 is the apparatus of any of embodiments 1-17 wherein the self-retracting fall-protection apparatus is a self-retracting lifeline or a self-retracting descender.

Embodiment 19 is a method of operating a self-retracting fall-protection apparatus, the method comprising: receiving and identifying a mechanical command signal originating from a safety line with a proximal end that is attached to a rotatable drum of the self-retracting fall-protection apparatus and with a distal end that is attachable to a harness of a user of the apparatus; and, upon receiving and identifying the mechanical command signal, performing at least one action.

Embodiment 20 is the method of embodiment 19 wherein the mechanical command signal is the result of manual manipulation of a distal section of the safety line by a user.

Embodiment 21 is the method of embodiment 19 performed using the apparatus of any of embodiments 1-18.

It will be apparent to those skilled in the art that the specific exemplary elements, structures, features, details, configurations, etc., that are disclosed herein can be modified and/or combined in numerous embodiments. All such variations and combinations are contemplated by the inventor as being within the bounds of the conceived invention, not merely those representative designs that were chosen to serve as exemplary illustrations. Thus, the scope of the present invention should not be limited to the specific illustrative structures described herein, but rather extends at least to the structures described by the language of the claims, and the equivalents of those structures. Any of the elements that are positively recited in this specification as alternatives may be explicitly included in the claims or excluded from the claims, in any combination as desired. Any of the elements or combinations of elements that are recited in this specification in open-ended language (e.g., comprise and derivatives thereof), are considered to additionally be recited in closed-ended language (e.g., consist and derivatives thereof) and in partially closed-ended language (e.g., consist essentially, and derivatives thereof). To the extent that there is any conflict or discrepancy between this specification as written and the disclosure in any document that is incorporated by reference herein but to which no priority is claimed, this specification as written will control.

What is claimed is:

1. A method of operating a self-retracting fall-protection apparatus, the method comprising:

receiving and identifying a mechanical command signal originating from a safety line with a proximal end that is attached to a rotatable drum of the self-retracting fall-protection apparatus and with a distal end that is attachable to a harness of a user of the apparatus; and, upon receiving and identifying the mechanical command signal, performing at least one action, wherein the mechanical command signal comprises a predetermined sequence of states of the safety line that is the result of deliberate manual manipulation of a distal section of the safety line by the user, and wherein the method comprises a preliminary step of choosing the predetermined sequence of states of the safety line that constitute the mechanical command signal, in view of a work environment in which the self-retracting fall-protection apparatus is to be used, and wherein the self-retracting fall-protection apparatus comprises a housing to which the rotatable drum is rotatably connected and further comprises a computing device configured to receive and identify the mechanical command signal that originates from the safety line, by way of at least one sensor that is resident on the housing of the apparatus and that is configured to sense a state of the safety line; and wherein the computing device is further configured to perform the at least one action upon receiving and identifying the mechanical command signal.

2. The method of claim 1 wherein the mechanical command signal comprises a predetermined sequence of motions of the safety line that includes at least one retraction of the safety line.

3. The method of claim 1 wherein the mechanical command signal comprises a predetermined sequence of motions of the safety line that includes at least one extension of the safety line.

4. The method of claim 1 wherein the mechanical command signal comprises a predetermined sequence of motions of the safety line that includes at least successive, alternating extensions and retractions of the safety line.

5. The method of claim 1 wherein the mechanical command signal includes at least one predetermined wait time interval during which the safety line is held stationary.

6. The method of claim 1 wherein the mechanical command signal includes at least one engaging of a braking mechanism of a housing of the self-retracting fall-protection apparatus.

7. The method of claim 6 wherein the mechanical command signal comprises a predetermined sequence of successive, alternating engagings and disengagings of the braking mechanism of the housing of the apparatus.

8. The method of claim 1 wherein the at least one housing-resident sensor is chosen from at least one of a position sensor, a tension sensor, a speedometer, or an accelerometer, and combinations thereof.

9. The method of claim 1 wherein the computing device is configured to receive and identify the mechanical command signal that originates from the safety line, by using at least one housing-resident sensor to directly interrogate at least one of a position, a tension, a speed, or an acceleration, of the safety line.

10. The method of claim 1 wherein the computing device is configured to receive and identify the mechanical command signal that originates from the safety line, by using at least one housing-resident sensor to interrogate at least one of a rotational position, a rotational tension, a rotational speed, or a rotational acceleration, of the rotatable drum to which the proximal end of the safety line is attached.

11. The method of claim 1 wherein the at least one housing-resident sensor is configured to sense a state of the safety line by way of monitoring at least one component of a braking mechanism of the housing of the apparatus.

12. The method of claim 1 wherein the at least one action that is performed is a non-mechanical action.

13. The method of claim 1 wherein the at least one action that is performed includes at least one of the following actions: changing the computing device from a stand-by state to a ready state; changing the computing device from a ready state to a stand-by state; performing a self-check of the computing device; logging a time event; logging an action and/or status of a user of the apparatus;

and monitoring an environmental parameter.

14. The method of claim 1 wherein the at least one action that is performed comprises a notification action chosen from the group of actions consisting of emitting a visible signal and emitting an audible signal.

15. The method of claim 1 wherein the computing device is configured to receive and identify an initial mechanical command signal, to send a request-for-confirmation signal upon receiving and identifying the initial command signal, to receive and identify a confirmation signal, and to take an action upon receiving and identifying the confirmation signal.

16. The method of claim 1 wherein the at least one action that is performed comprises a communication action comprising sending a wireless communication to a mobile device and/or to a base unit.

17. The method of claim 1 wherein the at least one action that is performed comprises a communication action chosen from the group consisting of: establishing communication with a mobile device carried by a user of the fall-protection apparatus and pairing the computing device with the mobile device; and, terminating communication with a mobile device with which the computing device had been previously communicating.

18. The method of claim 1 wherein the self-retracting fall-protection apparatus is a self-retracting lifeline or a self-retracting descender.

19. The method of claim 1 wherein the computing device comprises a menu of different mechanical command signals from which the mechanical command signal is chosen in the preliminary step.

* * * * *